US010192515B2

(12) United States Patent
Su et al.

(10) Patent No.: US 10,192,515 B2
(45) Date of Patent: Jan. 29, 2019

(54) DISPLAY DEVICE AND DATA DRIVER

(71) Applicant: AU Optronics Corporation, Hsin-Chu (TW)

(72) Inventors: Shih-Yuan Su, Hsin-Chu (TW); Kai-Yuan Siao, Hsin-Chu (TW); Jian-Feng Li, Hsin-Chu (TW); Chun-Kuei Wen, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 55 days.

(21) Appl. No.: 15/384,558

(22) Filed: Dec. 20, 2016

(65) Prior Publication Data

US 2018/0025696 A1 Jan. 25, 2018

(30) Foreign Application Priority Data

Jul. 22, 2016 (TW) ..... 105123238 A

(51) Int. Cl.

| | |
|---|---|
| ***G09G 5/00*** | (2006.01) |
| ***G09G 3/20*** | (2006.01) |
| *G09G 3/36* | (2006.01) |

(52) U.S. Cl.

CPC ..... *G09G 5/003* (2013.01); *G09G 3/20* (2013.01); *G09G 3/3666* (2013.01); *G09G 2300/0408* (2013.01); *G09G 2310/0221* (2013.01); *G09G 2310/0267* (2013.01); *G09G 2310/0275* (2013.01); *G09G 2310/0289* (2013.01);

(Continued)

(58) Field of Classification Search

CPC ..... G09G 5/003; G09G 2310/0267; G09G 2310/0275; G09G 2310/0289; G09G 2310/0291; G09G 3/3644; G09G 3/3666

See application file for complete search history.

(56) References Cited

U.S. PATENT DOCUMENTS 5,877,738 A * 3/1999 Ito ..... G09G 3/3622 345/103
6,483,497 B1 * 11/2002 Iino ..... G09G 3/3611 345/100
7,427,985 B2 9/2008 Chen et al.

(Continued)

FOREIGN PATENT DOCUMENTS

CN 1514424 A 7/2004
TW I259435 8/2006

OTHER PUBLICATIONS

Taiwan patent office "Office Action" dated Mar. 23, 2017, Taiwan.

*Primary Examiner* — Ricardo L Osorio
(74) *Attorney, Agent, or Firm* — WPAT, PC

(57) ABSTRACT

A data driver for a display device comprises a first boost circuit, a first gate clock generation circuit, a first level shift circuit, and a data drive circuit. The first boost circuit is used to receive a supply voltage value and generate at least one preset voltage value. The first gate clock generation circuit is electrically coupled to the first boost circuit, and is used to receive a plurality of timing signals and at least one preset voltage value, and generate at least one first timing signal. The first level shift circuit is used to receive the at least one first timing signal and generate at least one gate timing signal. The data drive circuit is used to receive the timing signals, and generate a plurality of display data signals.

9 Claims, 4 Drawing Sheets

(52) U.S. Cl.
CPC . *G09G 2310/0291* (2013.01); *G09G 2310/08* (2013.01); *G09G 2330/02* (2013.01)

(56) References Cited

U.S. PATENT DOCUMENTS

| | | | | |
|---|---|---|---|---|
| 8,031,152 | B2 * | 10/2011 | Yamamoto | G09G 3/3648 345/103 |
| 8,040,362 | B2 * | 10/2011 | Hu | G09G 3/3677 345/100 |
| 2002/0089485 | A1 * | 7/2002 | Youn | G09G 3/3614 345/99 |
| 2004/0125065 | A1 | 7/2004 | Park et al. | |
| 2006/0232579 | A1 | 10/2006 | Chen et al. | |
| 2008/0122817 | A1 * | 5/2008 | Cho | G09G 3/293 345/204 |
| 2014/0062980 | A1 * | 3/2014 | Kuo | G09G 3/344 345/204 |
| 2014/0210699 | A1 * | 7/2014 | Liu | G09G 3/3688 345/98 |
| 2015/0161960 | A1 * | 6/2015 | Park | G09G 3/3611 345/99 |

* cited by examiner

DISPLAY DEVICE AND DATA DRIVER

BACKGROUND

Technical Field

The present invention relates a display device and a data driver thereof, and in particular, a display device suitable for a narrow bezel and a data driver thereof.

Related Art

With the rapid development of science and technology, the life quality is improved, and consumers have increasingly high requirements on electronic devices, for example, pursuing for a lighter and thinner design, a higher speed, or a better visual effect. One method for improving the visual effect of an electronic device is to increase the display range of the electronic device. However, as the display range is increased, the area occupied by the bezel is reduced, and consequently the area for configuring hardware elements and circuit wirings is reduced, leading to difficulties in design.

SUMMARY

To achieve the foregoing objective of reducing the bezel in a more convenient manner, the present invention provides an embodiment of a data driver applicable to a display device, the data driver including a first boost circuit, a first gate clock generation circuit, a first level shift circuit, and a data drive circuit, where the first boost circuit is used to receive a supply voltage value, and generate at least one preset voltage value; the first gate clock generation circuit is electrically coupled to the first boost circuit, and is used to receive a plurality of timing signals and the at least one preset voltage value, and generate at least one first timing signal; the first level shift circuit is used to receive the at least one first timing signal and generate at least one first gate timing signal; and the data drive circuit is used to receive the timing signals, and generate a plurality of display data signals.

The present invention further provides a display device, including a power supply circuit, a timing controller, a first data driver, a gate driver, and a plurality of pixel units, where the power supply circuit is used to provide a supply voltage value; the timing controller is used to provide a plurality of timing signals; the first data driver is electrically coupled to the timing controller and the power supply circuit, and is used to receive the plurality of timing signals and the supply voltage value, and generate a plurality of display data signals and a plurality of first gateway timing signals; the gate driver is electrically coupled to the first data driver, and is used to receive the plurality of first gateway timing signals, and generate a plurality of gate driving signals; and the plurality of pixel units are electrically coupled to the first data driver and the gate driver, and are used to determine, according to the corresponding gate driving signals, whether to receive the corresponding display data signals.

Based on the above, because the data driver includes the first boost circuit, the first gate clock generation circuit, the first level shift circuit, and the data drive circuit, the number of elements and the volume of a printed circuit board can be effectively reduced, so that the area of a bezel of the display device can be reduced. In addition, because the timing controller is independent of the data driver, the data driver of the present invention receives timing signals output by a same timing controller, and when a single display device needs to be driven by a plurality of data drivers, the plurality of data drivers can perform operations without requiring any additional synchronization signal. In this way, the wiring space of the printed circuit board is released, thereby greatly facilitating the design of circuit wirings of the display device.

To make the aforementioned and other objectives, features and advantages of the present invention more comprehensible, embodiments accompanied with figures are described in detail below.

DETAILED DESCRIPTION

Figure 1:
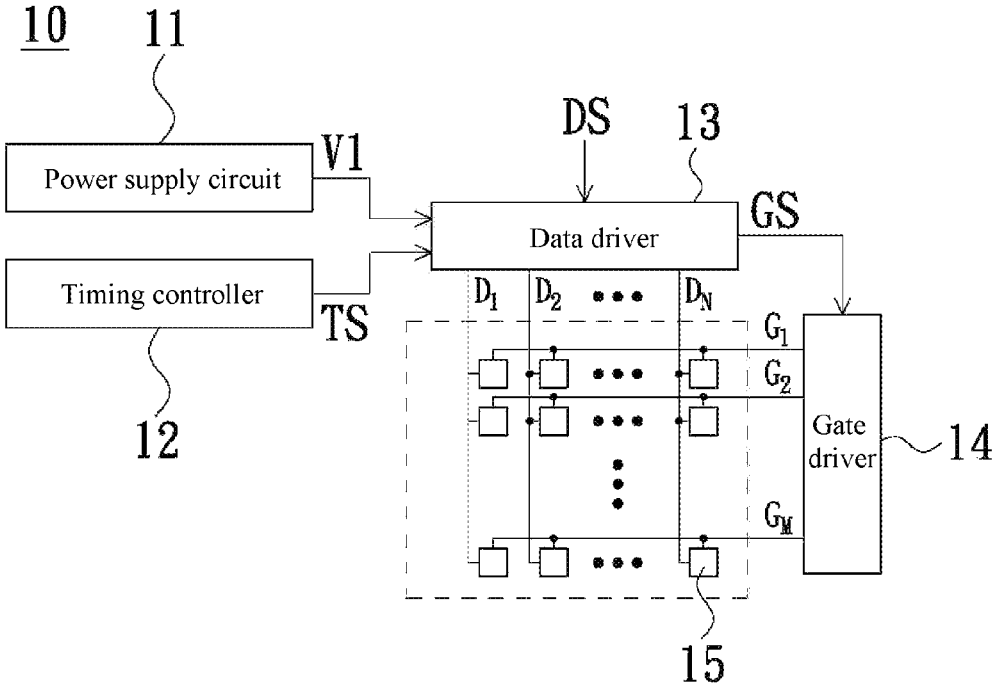
FIG. 1 is a schematic diagram of an embodiment of a display device of the present invention.

First, referring to FIG. 1, FIG. 1 is a schematic diagram of an embodiment of a display device 10 provided in the present invention. The display device 10 includes a power supply circuit 11, a timing controller 12, a data driver 13, a gate driver 14, and a plurality of pixel units 15. The power supply circuit 11 is used to provide a supply voltage value V1 to the data driver 13. The timing controller 12 is used to provide a plurality of different timing signals TS to the data driver 13. The timing signals TS are, for example, a first clock signal (CLK) and a second clock signal (XCK) with mutually inverted timings. The data driver 13 is electrically coupled to the power supply circuit 11, the timing controller 12, the gate driver 14, and the plurality of pixel units 15. The data driver 13 is used to generate corresponding display data signals $D_1, D_2, \ldots, D_N$ according to the supply voltage value V1, the plurality of timing signals, and a plurality of pieces of display data information DS received, and transmit the display data signals $D_1, D_2, \ldots, D_N$ to the corresponding plurality of pixel units 15. In addition, the data driver 13 is further used to generate a plurality of gate timing signals and transmit the gate timing signals to the gate driver 14. The gate driver 14 is used to generate a plurality of gate driving signals according to the received plurality of gate timing signals GS, and transmit the plurality of gate driving signals to corresponding gate lines, so that the pixel units 15 electrically coupled to the gate lines determine, according to the gate driving signals, whether to receive and display one of the display data signals $D_1, D_2, \ldots, D_N$.

Figure 2A:
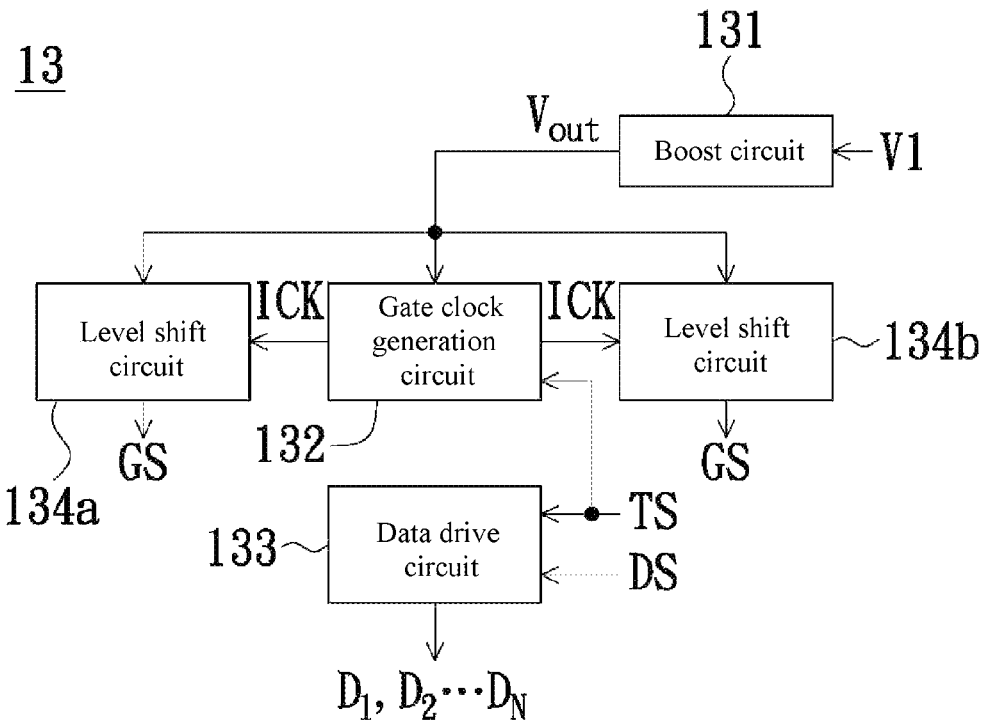
FIG. 2A is a schematic diagram of an embodiment of a data driver of the present invention.

Next, referring to FIG. 2A, FIG. 2A is a schematic diagram of an embodiment of a data driver 13 of the present invention. In this embodiment, the data driver 13 includes a boost circuit 131, a gate clock generation circuit 132, a data drive circuit 133, a first level shift circuit 134, and a second level shift circuit 134*b*. The boost circuit 131 is used to receive the supply voltage value V1, and generate a plurality of preset voltage values $V_{out}$ according to the supply voltage value V1. The preset voltage values $V_{out}$ are, for example, a high voltage level and a low voltage level. The gate clock generation circuit 132 is electrically coupled to the boost circuit 131, and the gate clock generation circuit 132 is used to receive the preset voltage values $V_{out}$ and the timing signals TS, and generate a plurality of initial timing signals ICK with different timings according to the preset voltage values $V_{out}$ and the timing signals TS, for example, a plurality of successive first timing signals $ICK_1$, $ICK_2$, . . . , $ICK_L$, where L is a positive integer greater than zero. The data drive circuit 133 is used to receive the plurality of pieces of display data information DS and the timing signals TS, and generate the display data signals $D_1$, $D_2$, . . . , $D_N$ according to the display data information DS and the timing signals TS, where N is a positive integer greater than zero. The data drive circuit 133 transmits the display data signals $D_1$, $D_2$, . . . , $D_N$ to the corresponding plurality of pixel units 15. The level shift circuit 134*a* is electrically coupled to the boost circuit 131 and the gate clock generation circuit 132. The level shift circuit 134*a* is used to receive the preset voltage values $V_{out}$ and the plurality of initial timing signals ICK, and perform level adjustment to generate a plurality of first gate drive timing signals, that is, the foregoing gate timing signals GS, for example, a plurality of gate clock signals $CLK_1$, $CLK_2$, . . . , $CKL_M$, where M is a positive integer greater than zero. The level shift circuit 134*a* transmits the plurality of first gate drive timing signals to the gate driver 14, so that the gate driver 14 generates a corresponding plurality of gate driving signals according to the plurality of gate drive timing signals. The second level shift circuit 134*b* is electrically coupled to the gate clock generation circuit 132, and is used to receive the initial timing signals ICK, for example, a second timing signal having a timing different from that of the first timing signal, and generate a plurality of second gate drive timing signals according to the initial timing signals ICK. Therefore, in this embodiment, the gate driver 14 generates a corresponding plurality of gate driving signals according to the first gate drive timing signals and the second gate drive timing signals. For example, the first gate drive timing signals are used to generate gate driving signals of odd-numbered rows of gate lines, and the second gate drive timing signals are used to generate gate driving signals of even-numbered rows of gate lines, but the present invention is not limited thereto. In other embodiments, the level shift circuit 134*a* and the level shift circuit 134*b* may be configured on opposite sides, that is, may be configured on the left and right sides of the data driver 13.

Figure 2B:
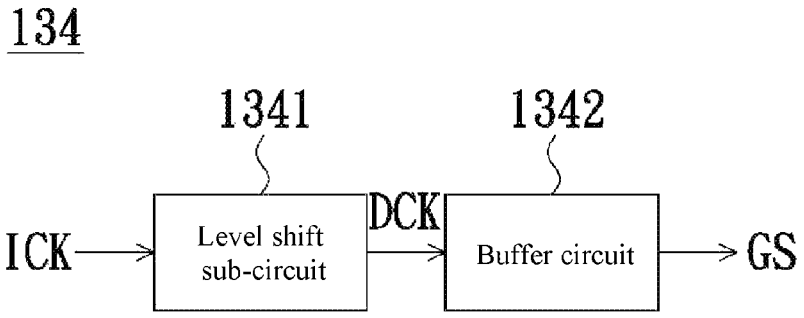
FIG. 2B is a schematic diagram of an embodiment of a level shift circuit of the present invention.

Referring to FIG. 2B, FIG. 2B is a schematic diagram of an embodiment of the level shift circuit 134. The level shift circuit 134 may include a level shift sub-circuit 1341 and a buffer circuit 1342. The level shift sub-circuit 1341 is used to adjust levels of received initial timing signals ICK according to requirements and output adjusted clock signals DCK obtained after the adjustment. After receiving the adjusted clock signals DCK, the buffer circuit 1342 buffers the plurality of adjusted clock signals DCK and then outputs the adjusted clock signals DCK as the gate timing signals GS. Therefore the output plurality of gate timing signals GS are non-overlapping with each other, that is, ON periods of the plurality of gate timing signals GS are non-overlapping. For example, periods in which the plurality of gate timing signals GS are at a logical high level are non-overlapping with each other.

Figure 3:
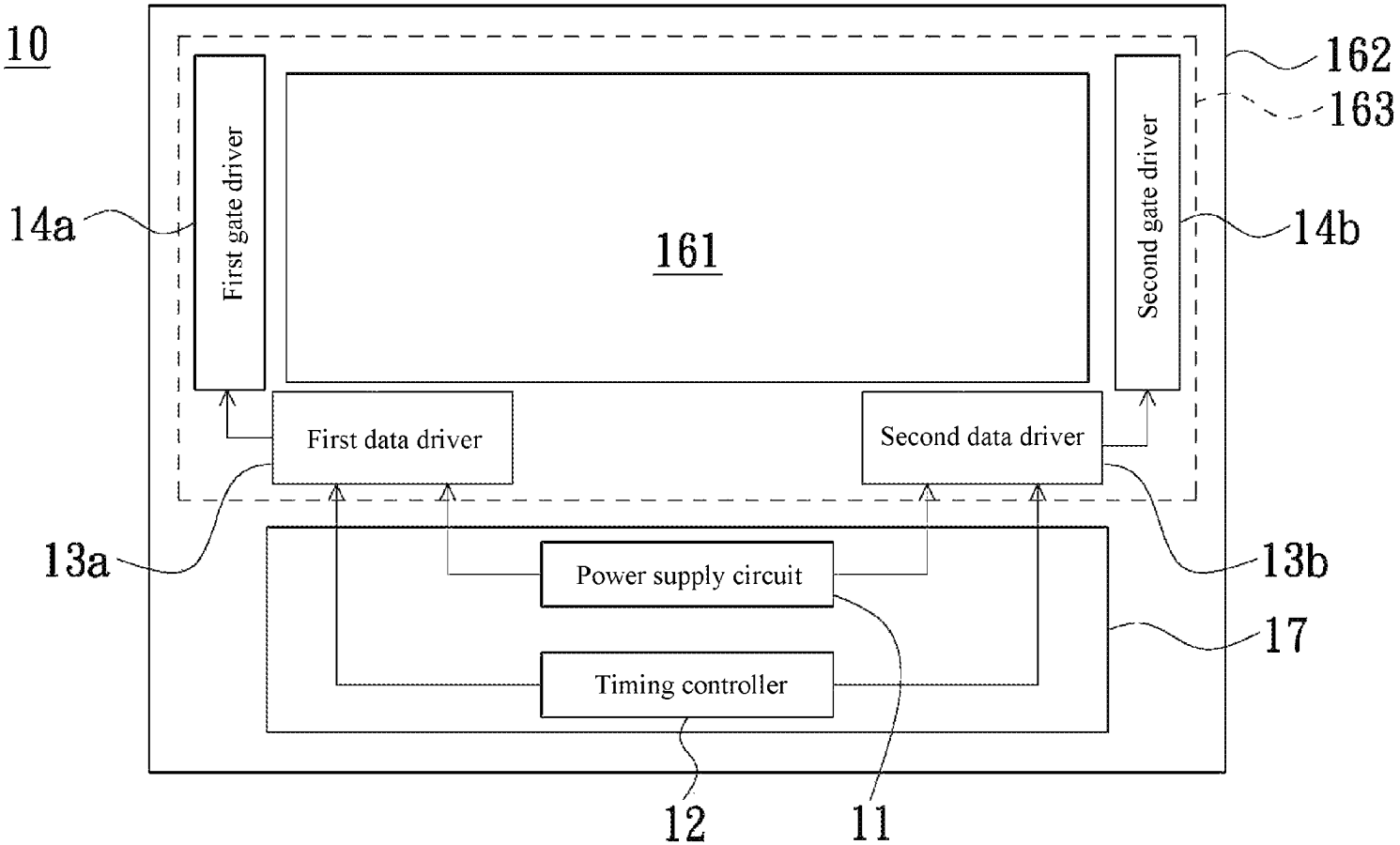
FIG. 3 is a schematic diagram of an embodiment of configuration of a display device of the present invention.
Figure 4:
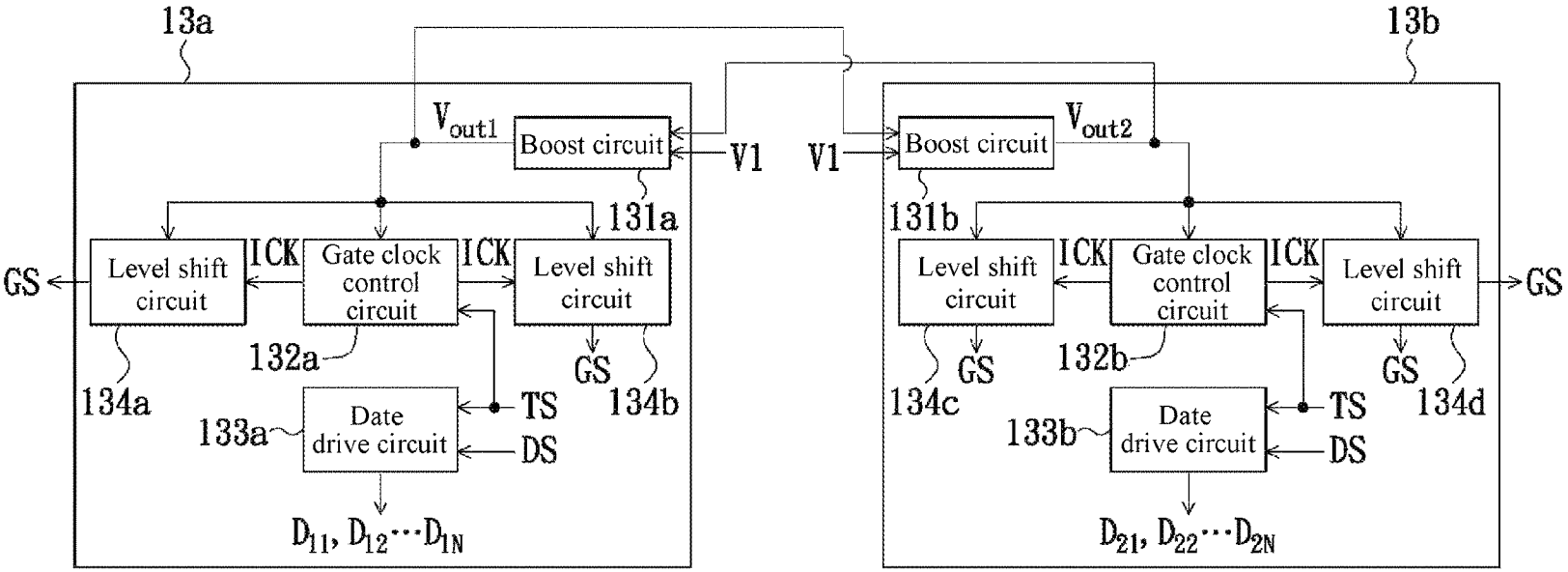
FIG. 4 is a schematic diagram of an embodiment of coupling of a level shift circuit of the present invention.

Next, referring to FIG. 3 and FIG. 4, FIG. 3 is a schematic diagram of an embodiment of configuration of the display device 10, and FIG. 4 shows an embodiment of configuration of the data driver. The display device 10 includes a display area 161 for display and a bezel area 162. The plurality of pixel units 15 is configured on a substrate 163 of the display device 10 and a user can watch a displayed image by using the display area 161. The power supply circuit 11, the timing controller 12, the data driver 13, and the gate driver 14 may be configured in the bezel area 162. In this embodiment, the display device 10 may include two data drivers 13 and two gate drivers 14, that is, a first data driver 13*a*, a second data driver 13*b*, a first gate driver 14*a*, and a second gate driver 14*b* as shown in FIG. 3. The first data driver 13*a*, the second data driver 13*b*, the first gate driver 14*a*, and the second gate driver 14*b* are configured on the substrate 163, and the first data driver 13*a* and the second data driver 13*b* may be individually configured on the left and right sides of the display device 10, and respectively electrically coupled to the first gate driver 14*a* and the second gate driver 14*b*. In this embodiment, the first gate driver 14*a* may be used to drive odd-numbered rows of gate lines, and the second gate driver 14*b* may be used to drive even-numbered rows of gate lines, but the present invention is not limited thereto. The user may configure gate lines that need to be driven by the first gate driver 14*a* and the second gate driver 14*b* according to requirements. According to the foregoing content, because the level shift circuit 134 has been integrated into the data driver 13, and the data driver 13 can be configured on the substrate 163 of the pixel unit 15, the wiring distance between the level shift circuit 134 and the gate driver 14 is effectively reduced. In this way, not only the wiring space is saved, but also a short wiring distance can effectively alleviate signal attenuation or distortion. Moreover, in this embodiment, only the power supply circuit 11 and the timing controller 12 are configured on a printed circuit board 17, and therefore the volume needed by the printed circuit board 17 is greatly reduced. The power supply circuit 11 and the timing controller 12 are electrically coupled to the first data driver 13*a* and second data driver 13*b* by the printed circuit board 17. Because timing signals TS needed by the first data driver 13*a* and the second data driver 13*b* are both provided by the timing controller 12, although the first data driver 13*a* and the second data driver 13*b* are used to drive different gate lines, no additional synchronization signal is needed to keep synchronization between them. The timing signals TS provided by the timing controller 12 enable the first data driver 13*a* and the second data driver 13*b* to correctly output a corresponding plurality of initial timing signals ICK according to the required timing, so that the first gate driver 14*a* and the second gate driver 14*b* can correctly generate corresponding gate control signals to control the plurality of pixel units 15 to display. Therefore, the present invention can further release the wiring space of the printed circuit board 17. Further, according to the foregoing other embodiments, as shown in FIG. 2A, each data driver 13 may further include two level shift circuits 134. Therefore, the first data driver 13*a* not only includes a boost circuit 131*a*, a gate clock generation circuit 132*a*, a data drive circuit 133*a*, and a level shift circuit 134*a*, but also further includes a level shift circuit 134*b*, where the data drive circuit 133*a* is used to output a plurality of display data signals $D_{11}$, $D_{12}$ . . . $D_{1N}$, and the boost circuit 131*a* is used to output a first voltage value $V_{out1}$; the second data driver 13*b* not only includes a boost circuit 131*b*, a gate clock generation circuit 132*b*, a data drive circuit 133*b*, and a level shift circuit 134*c*, but also further includes a level shift circuit 134*d*, where the data drive circuit 133*b* is used to output a plurality of display data signals $D_{21}$, $D_{22}$ . . . $D_{2N}$, and the boost voltage 131*b* is used to output a second voltage value $V_{out2}$, as shown in FIG. 4. Therefore, the user can determine, according to requirements, whether the data driver 13 synchronously uses two level shift circuits 134. That is, in some embodiments, the first data driver 13*a* and the second data driver 13*b* can drive all the pixel units 15 by using only one level shift circuit 134, or a single data driver 13 drives all the pixel units 15 by using two level shift circuits 134, for example, the level shift circuits 134*a* and 134*b*. In other embodiments, if the display device 10 has a large number of pixel units 15, the first data driver 13*a* and the second data driver 13*b* need to use all the level shift circuits 134 to drive the pixel units 15. When two level shift circuits 134 of two data drivers 13 need to be used for the number of pixel units 15, the level shift circuit 134*a* and the level shift circuit 134*d* can be individually electrically coupled to the first gate driver 14*a* and the second gate driver 14*b* by directly using the substrate 163 because the level shift circuit 134*a* and the level shift circuit 134*d* are configured on the left side of the first data driver 13*a* and on the right side of the second data driver 13*b*. In addition, because no synchronization is required between the first data driver 13*a* and the second data driver 13*b* and the wiring space on the printed circuit board 17 is released, and the level shift circuit 134*b* and the level shift circuit 134*c* are configured on the right side of the first data driver 13*a* and on the left side of the second data driver 13*b*, the level shift circuit 134*b* and the level shift circuit 134*c* can be electrically coupled to the gate driver 14 with a minimum wiring distance by using the wiring space released by the printed circuit board 17, so that the driving capability of the first data driver 13*a* and the second data driver 13*b* can be improved without increasing the area of the bezel area 162.

In the embodiment of the display device 10 in FIG. 4, the display device 10 includes the first data driver 13*a* and the second data driver 13*b*, so that the display device 10 has a good pixel driving capability. An output end of the boost circuit 131*b* of the second data driver 13*b* may be electrically coupled to an input end of the boost circuit 131*a* of the first data driver 13*a*, and an output end of the boost circuit 131*a* of the first data driver 13*a* may be electrically coupled to an input end of the boost circuit 131*b* of the second data driver 13*b*. Because the first data driver 13*a* and the second data driver 13*b* are used to drive different gate lines, and the gate lines are individually driven, only one boost circuit 131 is used to drive the gate lines at a time. When one of the boost circuit 131*b* and the boost circuit 131*a* needs to output the first voltage value $V_{out1}$ or the second voltage value $V_{out2}$ to drive the gate lines, to avoid the occurrence of under-voltages or severe voltage ripples occur in the boost circuit 131 due to an excessively large drawn current of the pixel units 15 when the gate lines are driven, taking the use of the boost circuit 131*a* to drive the gate lines as an example, the boost circuit 131*b* may output the second voltage value $V_{out2}$ as an input to the boost circuit 131*a*. When the pixel units 15 are driven, the second voltage value $V_{out2}$ output by the boost circuit 131*b* not only can increase the voltage driving capability of the first voltage value $V_{out1}$, but also can compensate for the first voltage value $V_{out1}$ in time when the pixel units 15 are driven, so as to avoid the occurrence of under-voltages or severe voltage ripples. In addition, because two boost circuits, that is, the boost circuit 131*a* and the boost circuit 131*b*, are used to share the burden of outputting a voltage value, the occurrence of over-temperature in the case where a single data driver 13 is used to drive the pixel units 15 can be effectively avoided.

In conclusion, because the data driver 13 of the present invention further includes the boost circuit 131, the gate clock generation circuit 132, and the level shift circuit 134 in addition to the data drive circuit 133, the volume of the printed circuit board 17 is effectively reduced. In addition, because the data driver 13 can be electrically coupled to the gate driver 14 without using wirings of the printed circuit board 17, not only the wiring distance can be reduced, but also signal attenuation can be alleviated. Further, because a plurality of data drivers 13 receive timing signals generated by a same timing controller 12, that is, the plurality of data drivers 13 can achieve an effect of clock synchronization by using the timing controller 12, no additional synchronization signal needs to be electrically coupled between the plurality of data drivers 13, so that the wiring space of the printed circuit board 17 can be released more effectively. Therefore, by means of the released wiring space and the plurality of level shift circuits 134, the pixel driving capability of the display device is further improved. Moreover, because the boost circuit 131*a* of the first data driver 13*a* is electrically coupled to the boost circuit 131*b* of the second data driver 13*b*, the boost circuit 131*a* may output the first voltage value $V_{out1}$ as an input to the boost circuit 131*b*, and the boost circuit 131*b* may output the second voltage value $V_{out2}$ as an input to the boost circuit 131*a*, the voltage value $V_{out}$ output by one boost circuit 131 can be used to assist in stabilizing the preset voltage value $V_{out}$ output by the other boost circuit 131. When an element draws a voltage, the assisting preset voltage value $V_{out}$ is used to compensate for the drawn preset voltage value $V_{out}$, so as to avoid the occurrence of under-voltages or severe voltage ripples in the boost circuit 131 of a single data driver 13 due to an excessively large drawn current. Furthermore, using more than one boost circuit 131 to share the burden of outputting a voltage value can further effectively avoid the occurrence of over-temperature in the case where a single data driver 13 is used.

The present invention is disclosed through the foregoing embodiments; however, these embodiments are not intended to limit the present invention. Various changes and modifications made by persons of ordinary skill in the art without departing from the spirit and scope of the present invention shall fall within the protection scope of the present invention. The protection scope of the present invention is subject to the appended claims.

What is claimed is:

1. A data driver applicable to a display device, comprising:

a first boost circuit, receiving a supply voltage value and generating a first boosted voltage at a first preset voltage value;

a first gate clock generation circuit, electrically coupled to the first boost circuit, receiving a plurality of timing signals and the first boosted voltage, and generating a first timing signal;

a first level shift circuit, receiving a first timing signal and generating a first gate timing signal; and a data drive circuit, receiving the plurality of timing signals and generating a plurality of display data signals;

wherein the first boost circuit is electrically coupled to a second boost circuit of a second data driver, and the second booster circuit generates a second boosted voltage at the first preset voltage value.

2. The data driver according to claim 1, wherein the first boost circuit outputs to the second boost circuit, and the second boost circuit outputs to the first boost circuit.

3. A data driver applicable to a display device, comprising:

a first boost circuit, receiving a supply voltage value and generating a first boosted voltage at a first preset voltage value;

a first gate clock generation circuit, electrically coupled to the first boost circuit, receiving a plurality of timing signals and the first boosted voltage, and generating a first timing signal;

a first level shift circuit, receiving a first timing signal and generating a first gate timing signal; and a data drive circuit, receiving the plurality of timing signals and generating a plurality of display data signals;

wherein the first gate clock generation circuit generates a second timing signal; and wherein the data driver comprises a second level shift circuit, receiving the second timing signal and generating a second gate timing signal, wherein the first level shift circuit is on a first side of the data driver, the second level shift circuit is on a second side of the data driver, and the first side is opposite to the second side.

4. A display device, comprising:

a power supply circuit, for providing a supply voltage value;

a timing controller, for providing a plurality of timing signals;

a first data driver, electrically coupled to the timing controller and the power supply circuit, receiving the plurality of timing signals and the supply voltage value, and generating a plurality of display data signals and a plurality of first gateway timing signals, wherein the first data driver comprises a first boost circuit receiving the supply voltage value and generating a first boosted voltage at a first preset voltage value;

a gate driver, electrically coupled to the first data driver, receiving the first gateway timing signals, and generating a plurality of gate driving signals; and a plurality of pixel units, electrically coupled to the first data driver and the gate driver, receiving the display data signals according to the gate driving signals;

wherein the first boost circuit is electrically coupled to a second boost circuit of a second data driver, and the second booster circuit generates a second boosted voltage at the first preset voltage value.

5. The display device according to claim 4, wherein the first data driver further comprises:

a first gate clock generation circuit, electrically coupled to the first boost circuit, receiving the plurality of timing signals and the first boosted voltage, and generating a first timing signal;

a first level shift circuit, receiving the first timing signal and generating a first gateway timing signal; and a data drive circuit, receiving the plurality of timing signals and generating the display data signals.

6. The display device according to claim 5, wherein the first gate clock generation circuit generates a second timing signal.

7. The display device according to claim 6, wherein the first data driver comprises a second level shift circuit, receiving the second timing signal and generating a second gate timing signal, wherein the first level shift circuit is on a first side of the first data driver, the second level shift circuit is on a second side of the first data driver, and the first side is opposite to the second side.

8. The display device according to claim 4, wherein the first boost circuit outputs to the second boost circuit, and the second boost circuit outputs to the first boost circuit.

9. The display device according to claim 4, wherein the power supply circuit and the timing controller are on a printed circuit board.

* * * * *